United States Patent [19]

Duddy

[11] 4,302,801

[45] Nov. 24, 1981

[54] LOW TEMPERATURE REFLECTOR FOR INDUSTRIAL LAMP

[76] Inventor: James J. Duddy, 514 N. Metcalf St., Lima, Ohio 45801

[21] Appl. No.: 87,415

[22] Filed: Oct. 22, 1979

[51] Int. Cl.[3] ..... F21V 7/00; F21V 29/00

[52] U.S. Cl. ..... 362/345; 362/264; 362/294; 362/302; 362/350; 362/353

[58] Field of Search ..... 362/264, 294, 302, 345, 362/350, 353

[56] References Cited

U.S. PATENT DOCUMENTS

| | | | |
|---|---|---|---|
| D. 167,268 | 7/1952 | Lordo | D26/24 |
| 1,273,995 | 7/1918 | Bohan | 362/289 |
| 1,402,374 | 1/1922 | Papini | 362/297 |
| 1,430,354 | 9/1922 | Burdick | 362/294 |
| 1,500,639 | 7/1924 | Rekar | 362/294 |
| 1,637,786 | 8/1927 | Rekar | 362/294 |
| 1,932,143 | 10/1933 | Piercy | 362/398 |
| 2,016,474 | 10/1935 | Wood | 362/294 |
| 2,069,950 | 2/1937 | Greppin | 362/294 |
| 2,300,523 | 11/1942 | Reichart | 362/353 |
| 2,726,323 | 12/1955 | Waterman | 362/353 |
| 2,799,773 | 7/1957 | Schwartz | 362/345 |
| 2,878,371 | 3/1959 | Hanlin | 362/294 |
| 3,009,053 | 11/1961 | Shaw | 362/294 |
| 3,066,219 | 11/1962 | Duddy | 362/294 |
| 3,119,567 | 1/1964 | Schwartz | 362/294 |
| 3,316,804 | 5/1967 | Weisglass | 362/350 |
| 3,325,639 | 6/1967 | King | 362/398 |

*Primary Examiner*—Stephen C. Bentley
*Assistant Examiner*—Edward F. Miles
*Attorney, Agent, or Firm*—C. Hercus Just

[57] ABSTRACT

An electric lamp reflector comprising a pair of similar, substantially hemispherical reflectors open at the outer ends and having inner openings coaxial with the central axis and said reflectors being nested together and uniformly spaced apart a limited distance except at the inner ends where cylindrical extensions are provided to engage each other and also fit only a cylindrical outer surface of a plastic electric lamp socket holder, the outer reflector having a circular row of holes therein spaced a limited distance from said cylindrical extension and adapted to permit circulation of ambient air to and from the inner reflector and lamp socket holder to render the temperature of the outer reflector safe to human touch.

5 Claims, 4 Drawing Figures

LOW TEMPERATURE REFLECTOR FOR INDUSTRIAL LAMP

BACKGROUND OF THE INVENTION

It is well-known that for either stationary or portable incandescent electric lamps, reflectors are highly desirable or necessary in order to economically employ the light emanating therefrom. As a result, many different types of reflectors have been developed and used heretofore for purposes of concentrating the light in various ways and/or reflecting it suitably upon surfaces or objects, particularly in industrial applications and especially relative to lamps used by mechanics of various types, including automobile mechanics, as well as shop workers, office workers, and in many other fields of application for such lights.

It is also well-known that many reflectors in use either in the past or at present become very hot, especially around the base portions which are nearest the end of the reflector attached to either a lamp socket per se or a lamp socket holder. Users of such lights or lamps have on many occasions been burned when touching such reflector, especially when touching the same accidentally. Accordingly, numerous attempts have been made in the past to develop reflectors for electric lamps or lights which have various types of ventilation means and a somewhat common attempt to effect such ventilating means comprises the use of a pair of nested reflectors attached to each other in various ways, as well as to the lamp socket or lamp socket holder. Typical of such previous attempts are the following U.S. Patents:

| | | |
|---|---|---|
| 1,273,995 | Bohan | 1918 |
| 1,402,374 | Papini | 1922 |
| 1,430,354 | Burdick | 1922 |
| 1,500,639 | Rekar | 1924 |
| 2,016,474 | Wood | 1935 |
| 2,799,773 | Schwartz | 1957 |
| 2,878,371 | Hanlin | 1959 |
| 3,119,567 | Schwartz | 1964 |
| Des. 167,268 | Lordo | 1952 |

Among the foregoing U.S. Pat. Nos. 1,273,995 to Bohan and 2,016,474 to Wood, provide a plurality of small heat transmitting holes in the lamp socket holder in an effort to cool said socket holder. U.S. Pat. No. 1,500,639 to Rekar, provides circular rows of small holes in the innermost reflector for purposes of discharging heated air emanating from the electric bulb. U.S. Pat. No. 1,402,374 to Papini merely uses a pair of nested reflectors without providing any means by which heated air from around the lamp may readily be discharged.

The other patents in the foregoing list, namely U.S. Pat. Nos. 1,430,354 to Burdick; 2,799,773 to Schwartz; 2,878,371 to Hanlin; 3,119,567 to Schwartz; and Des. 167,268 to Lordo, employ multiple nested reflectors associated with the electric lamps or bulbs in various ways and provided with heat dispelling openings, either in a socket portion in the outermost reflector surrounding or immediately adjacent the socket which holds the electric lamp or bulb.

Notwithstanding the foregoing attempts to maintain the outermost surface of the relector means associated with electric lamps and bulbs at a relatively comfortable or safe temperature, it has been found that the problem of supplying such type of reflector has not been solved to a satisfactory extent, and it is the principal object of the present invention to provide a reflector system in which the outermost surface of the outer reflector of a nested pair of the same is maintained at a temperature which is comfortable to the touch when contacted by human flesh and therefore is rendered relatively safe in use against the danger of being actually burned if such reflector surface is contacted by human flesh. Details of such reflector system is set forth below.

SUMMARY OF THE INVENTION

It is the principal object of the present invention to provide a pair of nested reflectors which are of similar shape and include hemispherical portions, the larger diameter being the outer end and open, while said reflectors are both provided with central openings coincident with the longitudinal axis which is perpendicular to the plane of the open outer end of the reflectors, said reflectors being uniformly spaced from each other a limited distance throughout their entire areas except at the central openings therein which are provided with cylindrical extensions arranged in several different embodiments for engagement with an outer, preferably cylindrical surface of a lamp socket holder and the outer reflector being provided with an appreciable number of similar holes of relatively large diameter arranged in a circular row adjacent said cylindrical extension but spaced therefrom a distance preferably equal to the diameter of said holes, whereby the arrangement and overall area of the holes relative to the surface area of the outer reflector is adequate to discharge heated air emanating from the inner reflector which, in turn, is heated by the electric lamp held in the socket within said lamp socket holder.

Another object of the invention is to provide in one embodiment of reflector assembly, a shallow annular seat on the cylindrical extension at the inner end of the inner reflector to dispose the same in accurately spaced relationship with the inner end of the cylindrical extension on the outer reflector, in this embodiment of the reflector assembly, the cylindrical extension on the inner reflector is disposed in close fitting relationship with the inner end of the cylindrical extension of the outer reflector and, if necessary to do so, small rivets may be employed to maintain the interfitting cylindrical portions in assembly, but the preferred construction thereof being such that there is a friction fit between the same.

A further object of the invention is to provide in a second embodiment of reflector assembly, a still further extension on the outer end of the cylindrical extension on the inner end of the outer reflector, said further extension being provided with another shallow seat which is annular and is abutted by the outer end of the cylindrical extension on the inner end of the inner reflector, whereby the cylindrical extension on the inner reflector is frictionally seated within the innermost portion of the cylindrical extension on the outer reflector and abuts the aforementioned seat, especially to dispose the major portions of the hemispherical areas of the two reflectors in uniformly spaced relationship with respect to each other, particularly adjacent the cylindrical extension portions thereof.

Still another object of the invention is to arrange the aforementioned circular row of ventilating holes in such manner that the portions of the outer reflector between said holes are shorter than the diameters of the holes, whereby a very substantial area of ventilating openings is provided and, particularly when the lamp assembly is arranged with a central horizontal axis, air is admitted through the lowermost holes and flows around the innermost portion of the inner reflector and exists through the uppermost holes in the outer reflector.

One further object of the invention is to provide one or the other of the inner or outer reflectors respectively at the inner ends thereof adjacent the cylindrical extensions with annular seat members which cooperate with the terminal end of the cylindrical extension of the other reflector to accurately position the same axially with respect to each other and thereby effect desired spacing between especially the hemispherical portions of the reflectors, said annular seat members actually comprising annular shoulders formed in said inner ends of the reflectors incident to shaping the same during manufacturing, the respective embodiments of said reflectors having said annular seat members on the cylindrical extensions of the inner and outer reflectors.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

Figure 1:
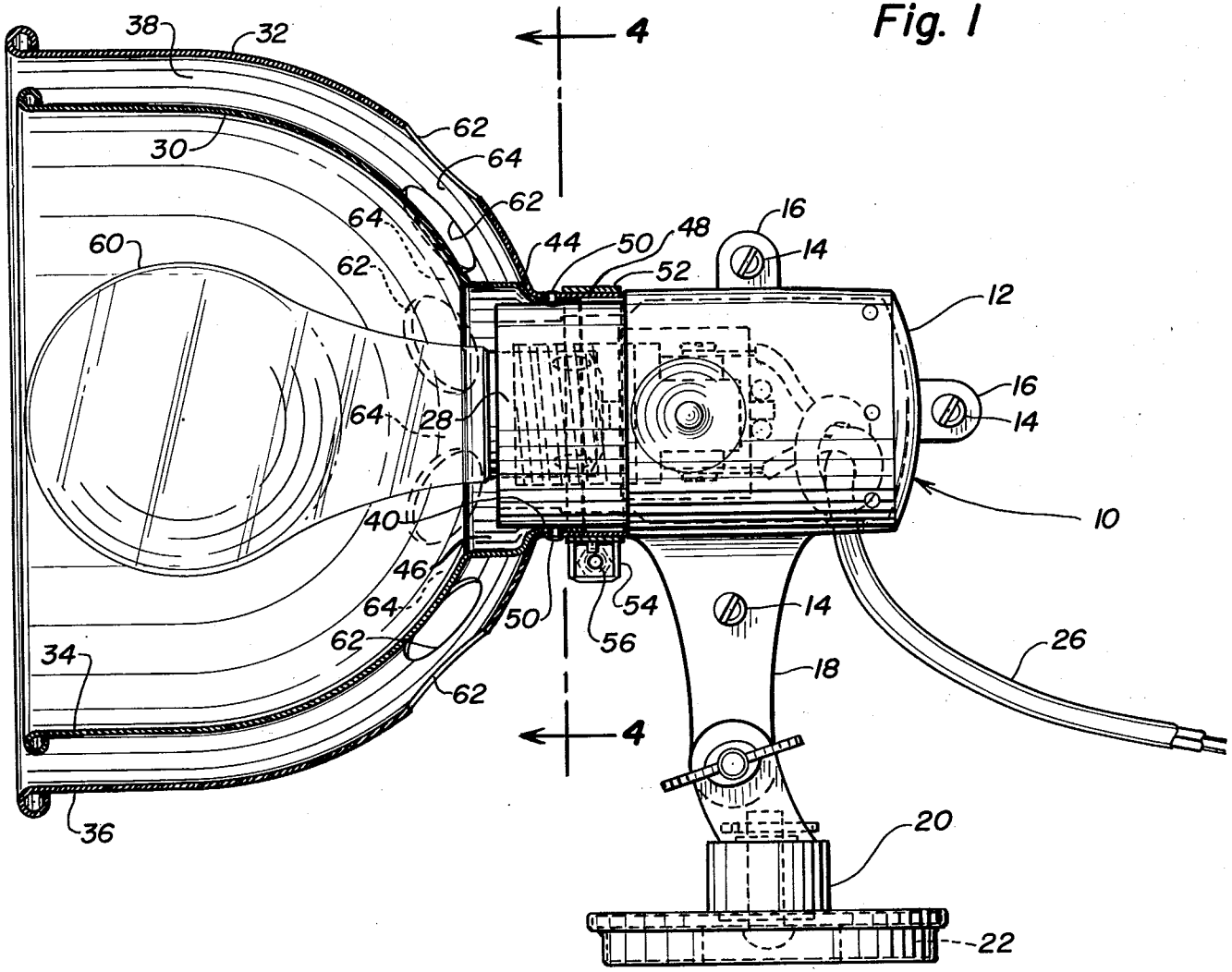
FIG. 1 is a side elevation, partly in vertical section, showing one embodiment of the reflector system which includes the features of the invention, the vertical section of the reflectors per se being positioned operatively upon the outer end of a molded bi-partite lamp socket holder, which is illustrated in full side elevation.
Figure 3:
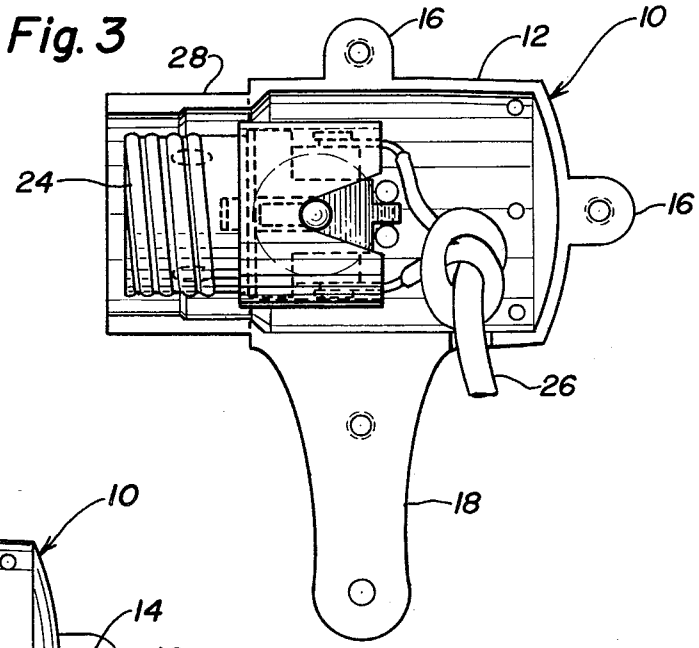
FIG. 3 is a side elevation of one of the bi-partite molded sections of the lamp socket holder in which a conventional electric lamp socket is positioned operatively for the reception of the threaded end of an electric bulb or lamp in said socket and the fragmentary portion of an electric conduit being shown connected to terminals of said lamp socket.
Figure 4:
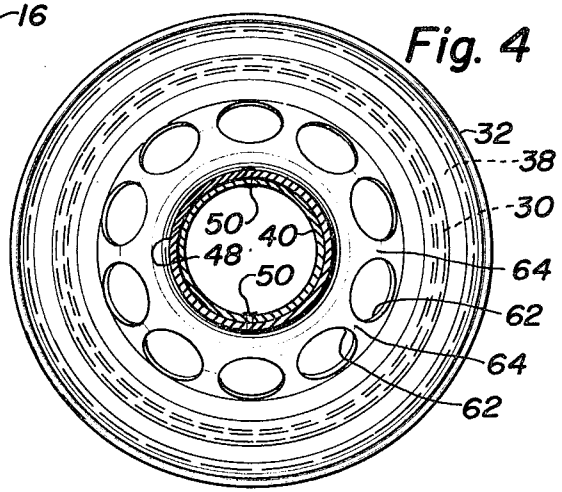
FIG. 4 is a vertical sectional elevation as viewed from the inner ends of the reflector assembly as seen on the line 4—4 of FIG. 1.
Figure 2:
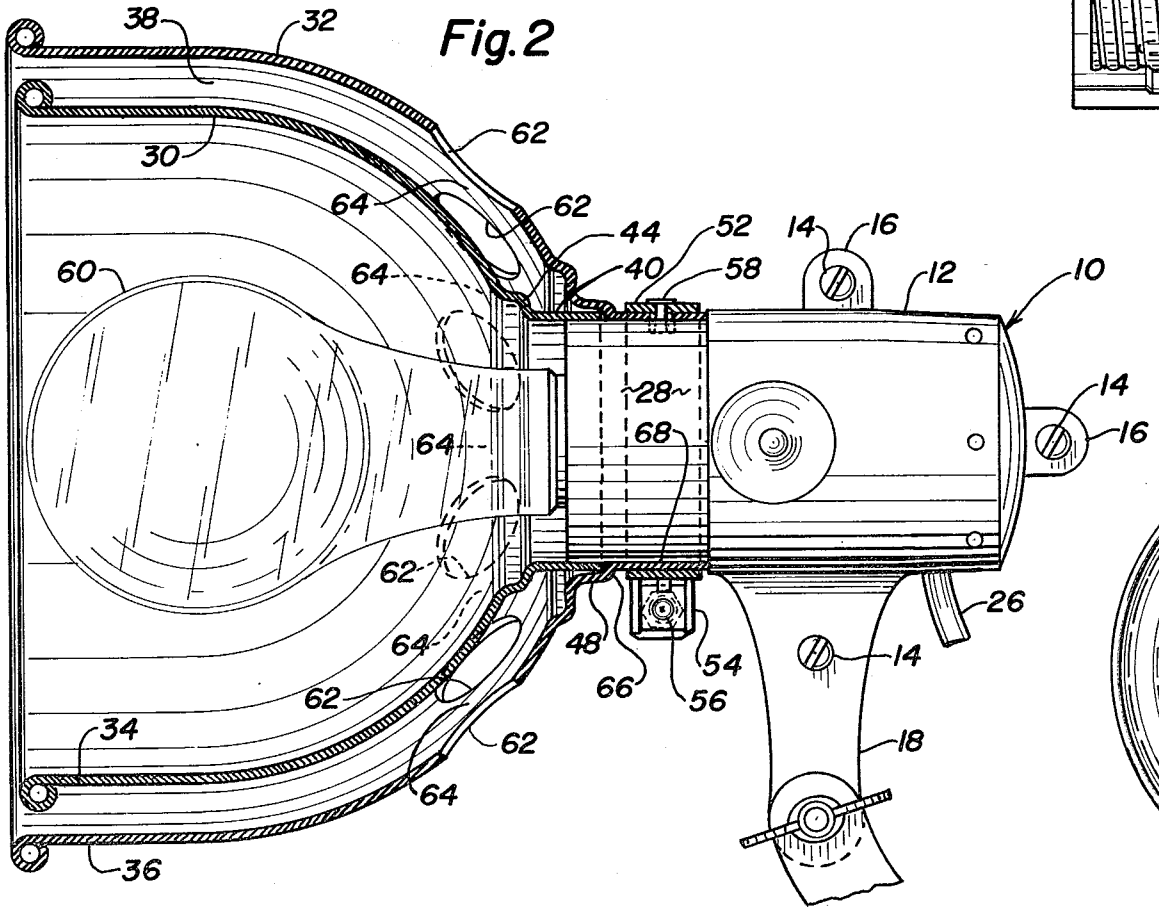
FIG. 2 is a view similar to FIG. 1, but illustrating a second embodiment of the invention in which the reflector system is shown in vertical section and attached to the forward end of a lamp socket holder shown in full side elevation, except for the lower supporting member which is broken away to adapt the figure to the sheet.

Referring to FIGS. 1 and 2, an exemplary lamp 10 is illustrated which comprises a preferably bi-partite molded lamp socket holder 12, which is formed preferably from a suitable rigid synthetic resin, such as commercially sold under the trade name "Nylon," the two sections of the holder preferably being mirror images of each other and secured together by screws 14 which extend through appropriate openings in mating ears 16 respectively formed on the two sections of holder 12. Said sections also include similar parts of an extension 18 depending from the holder 12 and these also being secured together by another screw 14, extending through said sections.

The lamp socket holder preferably is supported by an appropriate base 20, which is pivotally connected to the extension 18 by a conventional bolt and wing nut. Especially for purposes of utilizing the lamp in conjunction with metal supporting members, such as automobile bodies and the like, the base 20 has a magnet 22 secured to the lower face thereof for purposes of effectively and strongly securing the lamp 10 removably to a work surface or the like, machines, tools, and otherwise.

Mounted within the hollow interior of the lamp socket holder 12 is a conventional electric lamp or light socket 24 having a threaded tubular outer end connected to an appropriate terminal and switching mechanism of standard type to which ends of a double cord type electric conduit 26 are affixed. Particularly in accordance with the present invention, the outer surface of the forward end of the lamp socket holder 12 is machined or otherwise suitably formed to provide a cylindrical outer surface 28 for purposes of providing a support to which the inner ends of the inner and outer reflectors 30 and 32 are connected either by frictional means or with the aid of a clamping collar, to be described in detail hereinafter.

Preferably, the inner and outer reflectors 30 and 32 are of similar shape with the exception that they are spaced from each other as described below and the major portions of the reflectors are hemispherical, the outer ends thereof being open and preferably within a common plane. The terminal portions 34 and 36 of the reflectors 30 and 32 also preferably are substantially cylindrical for a short portion of the length thereof and the outer ends are rolled in conventional manner to provide strength to resist bending.

The inner ends of the inner and outer reflectors 30 and 32 are attached by appropriate means to the outer surface 28 of the holder 12, said attaching means comprising several embodiments respectively shown in FIGS. 1 and 2 and serving the purpose of spacing the hemispherical portions of the inner and outer reflectors 30 and 32 uniformly apart to provide a substantially hemispherical space 38.

To effect the connection of the inner reflector 30 to the outer surface 28 of holder 12, the central opening of said inner end is integral with a cylindrical sleeve 40 which extends rearwardly therefrom, preferably for frictional engagement with the outer surface 28 of holder 12. Also, either by spinning or otherwise, the inner end portion of the inner reflector 30 is provided with an annular shoulder 44 which forms a seat against which a portion of the inner end of the outer reflector 32 abuts, as shown in FIG. 1, for purposes of effectively positioning the reflectors with respect to each other to form the hemispherical space 38. It also will be noted that an intermediate portion of the inner end of the inner reflector 30 between the central opening in the hemispherical portion and the cylindrical sleeve 40 provides a desired annular space 46 between the inner end of the reflector 30 and the terminal end of the cylindrical outer surface 28 of holder 12, especially for purposes of aiding in minimizing the accumulation of heat in the vicinity of the lamp or light socket 24.

Also referring to FIG. 1, it will be seen that the inner end of the hemispherical portion of the outer reflector 32, adjacent the central opening therein terminates in another cylindrical sleeve 48 which is complementary to and nested with the cylindrical sleeve 40 of the inner reflector 30 and, in accordance with one embodiment of the invention, the coaxial cylindrical sleeves 40 and 48 may be connected by a limited number of appropriate rivets 50 or the like. The inner ends of said rivets also, if desired, may frictionally engage the cylindrical outer surface 28 of holder 12 to facilitate the accurate positioning of the assembled reflectors with respect to the lamp socket holder 12. Either alternatively or in conjunction with the rivets 50, the coaxially assembled cylindrical sleeves 40 and 48 may effectively be clamped with respect to the cylindrical outer surface 28 of holder 12 by the employment of a clamping collar 52 having ears 54 which are brought into clamping engagement by means of an appropriate bolt or screw 56. To complete the assembly, a conventional electric lamp or bulb 60 is illustrated with the threaded end thereof positioned within the electric lamp socket 24 in conventional manner.

One of the major features and improvements of the invention comprises the provision of effective air-circulating means in the reflector assembly, said means for both the embodiments being similar. In the embodiment shown in FIG. 1, it will be seen that said air-circulating means comprises holes 62, which are evenly spaced in a circular row. The diameter of the holes is preferably approximately half the diameter of the cylindrical outer surface 28 of the lamp socket holder 12 and the depth of space 38 between the reflectors preferably is equal to about half the diameter of said holes. The diameter and number of said holes is selected so that the metal portions 64 of the reflector between said holes is approximately only half as wide as the diameter of the holes. To more accurately describe the size, number, and location of said holes, a typical example of the reflectors made in accordance with the invention and suitably tested have the following dimensions which are stated solely by way of example rather than restriction. The diameter of the outer end of the outer reflector 32 is approximately $5\frac{1}{2}$ inches and the diameter of the outer end of the inner reflector is approximately $4\frac{1}{2}$ inches. The overall axial length of the outer reflector is approximately $4\frac{1}{2}$ inches and there are ten holes 62, evenly spaced from each other and $\frac{3}{4}$ inch in diameter in the outer reflector, the inner edges of said holes being approximately $\frac{3}{4}$ inch from the central hole of the outer reflector 32 with which the cylindrical sleeve 48 is integral. Under the circumstances, the metal portions 64 between the holes are approximately $\frac{1}{2}$ inch wide at the narrowest part.

Particularly when the reflector assembly and lamp are disposed substantially horizontally as viewed in FIG. 1, ambient air will enter the lowermost holes 62 in the outer reflector 32 and circulate around the adjacent portions of the inner reflector 30 which are those portions that will be subjected to the greatest heat from the lamp 60. The circulating air will exit through the uppermost holes 62, and in doing so, will maintain the outer reflector 32 comfortable to the touch and at a temperature far below any which will cause a burn to human tissue if touched. By way of experimental example, it has been found that the temperature of the outer surface of the outer reflector is approximately 110° F., whereas the temperature of the inner reflector in the region of the holes 62 is approximately 190° F. Another important factor is that the space 38 which is of uniform thickness between the nested inner and outer reflectors is approximately $\frac{1}{2}$ inch in thickness but such dimension is primarily indicated for examplary purposes rather than limitation, but actually is the distance provided in the aforementioned reflectors that were tested as indicated above. In view of the positioning between the inner ends of the reflector afforded by the annular shoulder 44 in the inner reflector, it will be seen from FIG. 1 that a relatively uniform space between the reflectors extends as far as possible to the inner ends of said reflectors adjacent the cylindrical sleeves 40 and 48 thereof.

Another embodiment of the invention is illustrated in FIG. 2 wherein the same numerals are used as far as possible to indicate similar elements as found in the embodiment shown in FIG. 1. The general overall shape of the reflectors 30 and 32 and the air-transmitting holes 62 in the outer reflector are the same in both embodiments. The principal difference resides in the inner end portions of the reflectors, particularly the outer reflector, due to the fact that the cylindrical sleeve 48 intermediately of the ends thereof, is provided with a further short shoulder 66 against which the inner end of the cylindrical sleeve 40 of the inner reflector 30 abuts and the innermost end of the cylindrical sleeve 48 is constricted to a limited extent by the provision of the shoulder 66 and thereby forms a cylindrical terminal end portion 68 which has an inner diameter closely conforming to the outer diameter of the cylindrical outer surface 28 of socket holder 12. However, if desired, the clamping collar 52, similar to that shown in FIG. 1, may be applied to the terminal end portion 68 to effect a tighter engagement of the outer reflector with the lamp socket holder 12. Otherwise, the embodiment shown in FIG. 2 performs very similarly to that shown in FIG. 1 with respect to effecting cooling of the outer surface of the outer reflector 32, details of which are described hereinabove with respect to the embodiment shown in FIG. 1.

Short stud 58 passes preferably through a hole in cylindrical sleeve 48 of the outer reflector 32 and engages the reduced outer surface 28 of lamp socket holder 12.

In selecting dimensions and sizes of reflectors of the type embodying the present invention, it is essential that practical dimensions be employed, especially for convenience and to prevent blocking of view in situations where such lamps are employed as, for example, when attached to machine tools, work benches, as well as to objects being worked on, such as automobiles in body repair and the like. For example, if the outer reflector is made of a substantially larger diameter than that described hereinabove, and the air passage holes of the type illustrated are employed in a similar location in such larger size of outer reflector, the temperature of 110° F. would be substantially lowered and probably would be in the range of 80° or 90° F. However, such larger diameter outer reflector would, in many situations, provide obstruction to viewing work being undertaken in the vicinity of the lamp. Accordingly, especially with a view to providing compactness and limited size, the dimensions referred to specifically in the foregoing description have been chosen to be of a practical nature.

It also has been found that if the cylindrical sleeves respectively on the inner and outer reflectors are mounted upon the outer end of the lamp socket holder so as to be slightly out of contact with each other, such arrangement also will result in the temperature of the outer reflector being below the indicated 110° F. However, such an arrangement requires care in assemblying the reflectors respectively upon the lamp socket holder and in devising any type of product which the public uses, only a minimum amount of assembly operations are preferred because of a tendency on the part of the public not to observe operation instructions included with manufactured products. Accordingly, the present invention has provided connections between the cylindrical sleeve on the inner and outer reflectors for convenience in mounting the same upon the lamp socket holder and still provide an assembly in which the temperature of the outer reflector is only slightly above body temperature of human beings, and the foregoing examples are the result of using an electric bulb of 150 watts.

It also has been found from actual practice that when the reflectors are pointed upward, as when the base is supported on a horizontal surface, such as a floor or bench, the venting system of the reflectors functions to draw in cool air through the airtransmitting holes 62 and discharge upwardly in a manner to maintain the temperature of the outer reflector sufficiently cool to be comfortable to human tissue if it contacts said reflector.

Further, the magnetic base 20 is readily capable of being attached magnetically to a small steel plate of greater width than the base, whereby the plate may be placed upon a horizontal surface and support the lamp by gravity or by punching a hole in the plate, the lamp and plate may be hung on a wall, if desired.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An electric lamp reflector system comprising in combination, a hollow plastic electric lamp socket holder housing a socket of conventional domestic size and having a substantially cylindrical outer surface adjacent the outer end thereof, a first metallic reflector substantially hemispherical in shape and open at the outer end and having in the other end a central opening terminating in a short cylindrical portion complementary to the diameter of said cylindrical outer surface of said socket holder and fitted on the same for support, a short portion of the outer end of said first reflector being substantially cylindrical, a second metallic reflector of similar shape and surrounding said first reflector and spaced a substantially uniform limited distance from said first reflector throughout the curved area thereof, said second reflector having an open outer end and the other end having a central opening terminating in a cylindrical sleeve closely surrounding and interfitting with said short cylindrical portion of said first reflector and extending a limited distance beyond the outer end thereof, said first reflector also having an annular shoulder of limited diameter adjacent the inner end of said short cylindrical portion and spaced from the curved portion of said first reflector a distance equal to the spacing between said first and second reflectors and operable to establish said spacing upon assembling said reflectors, and a circumferentially spaced circular row of heat transmitting circular holes in said second reflector and each of uniform diameter substantially half the diameter of said cylindrical outer surface of said socket holder and the edges of said holes nearest said cylindrical sleeve being spaced from said sleeve a distance substantially equal to the diameter of said holes, whereby ambient air passes through certain of said holes and exits through others, thereby maintaining said reflectors at a temperature incapable of producing a burn on human tissue when said reflectors are disposed horizontally.

2. The reflector system according to claim 1 in which said holes in said second reflector are spaced apart a distance substantially equal to one-half the diameter of said holes.

3. The reflector system according to claim 1 further including a clamping ring surrounding the outer end portion of said cylindrical sleeve of said second reflector and provided with a short radial stud on the inner surface thereof adapted to pass through a hole in said sleeve to engage said cylindrical surface of said socket holder to clamp the combined reflectors upon the same.

4. The reflector system according to claim 1 in which said substantially uniform spacing between said reflectors is substantially equal to approximately half the diameter of said holes in said second reflector.

5. The reflector system according to claim 1 further characterized by said cylindrical sleeve of said second reflector having an internal shoulder therein at the junction of said cylindrical sleeve with said second reflector and the annular shoulder adjacent the inner end of said short cylindrical portion on said first reflector abutting said internal shoulder of said second reflector to position said first reflector in operative position relative to said second reflector.

* * * * *